US010234825B2

(12) United States Patent
Mueller et al.

(10) Patent No.: US 10,234,825 B2
(45) Date of Patent: Mar. 19, 2019

(54) APPARATUS FOR TIME-CONTROLLED ACTIVATION OR DEACTIVATION OF A VEHICLE FUNCTION

(71) Applicant: Bayerische Motoren Werke Aktiengesellschaft, Munich (DE)

(72) Inventors: Stephan Mueller, Munich (DE); Ronald Ecker, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 360 days.

(21) Appl. No.: 14/684,884

(22) Filed: Apr. 13, 2015

(65) Prior Publication Data

US 2015/0293501 A1 Oct. 15, 2015

(30) Foreign Application Priority Data

Apr. 14, 2014 (DE) ..... 10 2014 207 146

(51) Int. Cl.
*G04G 5/04* (2006.01)
*G04B 19/22* (2006.01)

(52) U.S. Cl.
CPC ..... *G04G 5/04* (2013.01); *G04B 19/22* (2013.01)

(58) Field of Classification Search
CPC ..... G04B 19/22; G04G 5/04
USPC ..... 368/6, 9, 275
See application file for complete search history.

(56) References Cited

U.S. PATENT DOCUMENTS

2004/0203951 A1* 10/2004 Mazzara, Jr. ..... G06F 1/14 455/466
2005/0216458 A1* 9/2005 Morris ..... B60K 35/00
2006/0002238 A1* 1/2006 Morris ..... G04G 5/002 368/47
2006/0155445 A1* 7/2006 Browne ..... B60K 37/06 701/49

(Continued)

FOREIGN PATENT DOCUMENTS

CN 1304103 A 7/2001
CN 1786999 A 6/2006

(Continued)

OTHER PUBLICATIONS

Andreas et al., DE 19756628 A1 Translation, Jul. 1, 1999, full document.*

(Continued)

*Primary Examiner* — Daniel P Wicklund
(74) *Attorney, Agent, or Firm* — Crowell & Moring LLP

(57) ABSTRACT

A method and apparatus are provided for time-controlled activation of a vehicle function in a vehicle with automatic adjustment of the time of a vehicle-internal clock from standard time to daylight saving time and/or from daylight saving time to standard time. An operator control element is provided for manually selecting an activation instant. An electronic control unit takes the activation instant and the time of the vehicle-internal clock as a basis for prompting activation of the vehicle function when the activation instant has been reached. Selection of an activation instant that occurs only after an automatic changeover of the vehicle-internal clock from standard time to daylight saving time or from daylight saving time to standard time is to be expected prompts output of appropriate indicator.

14 Claims, 1 Drawing Sheet

(56) References Cited

U.S. PATENT DOCUMENTS

| | | | | |
|---|---|---|---|---|
| 2011/0077855 | A1* | 3/2011 | Sumizawa | G08G 1/096888 701/533 |
| 2011/0137519 | A1* | 6/2011 | Christie | B60K 37/02 701/36 |
| 2011/0255376 | A1* | 10/2011 | Heers | B60K 35/00 368/6 |
| 2011/0295462 | A1* | 12/2011 | Park | G04R 20/06 701/36 |
| 2015/0378315 | A1* | 12/2015 | Takahashi | H01M 10/44 701/123 |

FOREIGN PATENT DOCUMENTS

| | | | |
|---|---|---|---|
| CN | 101305245 | A | 11/2008 |
| CN | 103686277 | A | 3/2014 |
| DE | 197 56 628 | A1 | 7/1999 |

OTHER PUBLICATIONS

German Search Report dated Feb. 9, 2015, with partial English translation (twelve (12) pages).

Chinese Office Action issued in Chinese counterpart application No. 201510189400.6 dated Aug. 8, 2018, with partial English translation (Eight (8) pages).

Chinese Office Action issued in Chinese counterpart application No. 201510189400.6 dated Jan. 2, 2019, with partial English translation (Sixteen (16) pages).

* cited by examiner

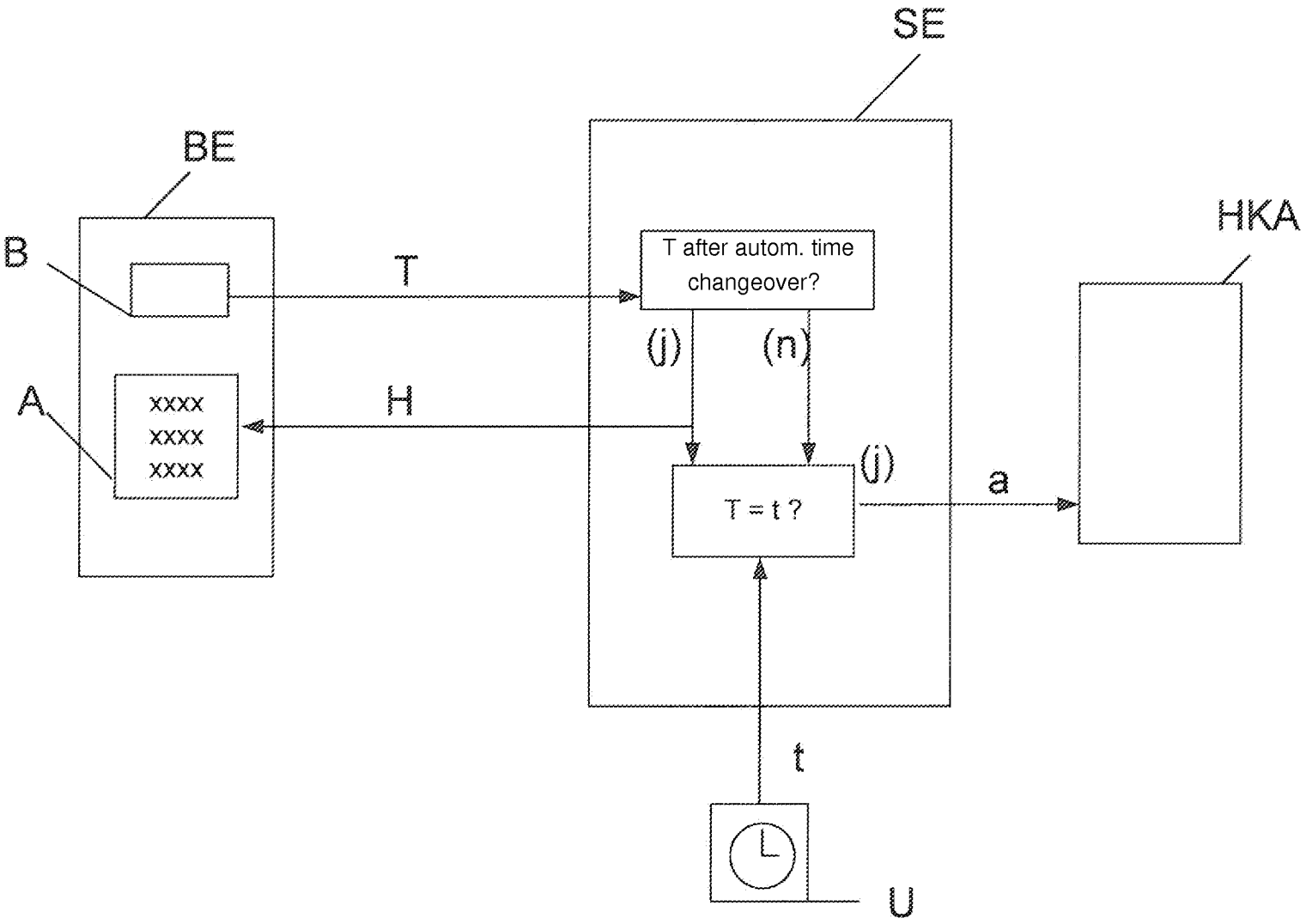
HKA
SE
a
T after autom. time changeover?
(n)
(j)
(j)
T = t ?
t
U
T
H
BE
xxxx
xxxx
xxxx
B
A

APPARATUS FOR TIME-CONTROLLED ACTIVATION OR DEACTIVATION OF A VEHICLE FUNCTION

CROSS REFERENCE TO RELATED APPLICATIONS

This application claims priority under 35 U.S.C. § 119 from German Patent Application No 10 2014 207 146.1, filed Apr. 14, 2014, the entire disclosures of which are herein expressly incorporated by reference.

BACKGROUND AND SUMMARY OF THE INVENTION

The invention relates to a method and an apparatus for time-controlled activation of a vehicle function in a vehicle with automatic adjustment of the time of a vehicle-internal clock from standard (normal) time to daylight saving (summer) time and/or from daylight saving (summer) time to standard (normal) time, and to a corresponding apparatus for time-controlled deactivation of a vehicle function.

At present, some vehicles already have provision for automatic time changeover from standard time to daylight saving time and vice versa, or when changing a time zone. In this case, the automatic adjustment of the central clock of the vehicle can be effected in a similar manner to a conventional clock radio, for example, by virtue of the time being readjusted on the basis of a time signal that is broadcast via radio by a time signal transmitter.

In addition, various apparatuses for time-controlled activation of vehicle functions are also already known. By way of example, DE 197 56 628 A1 discloses a stationary heater for a vehicle, wherein the instant and/or the period of the stationary heating mode can be set by an operator using a time switch provided for this purpose. The time switch includes a radio reception module that can be used to receive signals for automatically changing over from standard time to daylight saving time and vice versa, so that the operator does not need to be mindful of the correctly set time while changing over the clock from standard time to daylight saving time or vice versa.

It is an object of the present invention to improve an apparatus—which is improved in terms of convenience for the user—for time-controlled activation or deactivation of a vehicle function in a vehicle with automatic adjustment of the time still further, so that operating errors are avoided.

This and other objects are achieved by an apparatus for time-controlled activation of a vehicle function in a vehicle with automatic adjustment of the time of a vehicle-internal clock from standard time to daylight saving time and/or from daylight saving time to standard time, having an operator control element for manually selecting an activation instant and having a control unit that takes the activation instant and the time of the vehicle-internal clock as a basis for prompting activation of the vehicle function when the activation instant has been reached. Selection of an activation instant, which occurs only after an automatic changeover of the vehicle-internal clock from standard time to daylight saving time or from daylight saving time to standard time is to be expected, prompts output of an indicator. Such objects are also achieved by time-controlled deactivation of a vehicle function in a vehicle with automatic adjustment of the time of a vehicle-internal clock from standard time to daylight saving time and/or from daylight saving time to standard time, having an operator control element for manually selecting a deactivation instant, and having a control unit that takes the deactivation instant and the time of the vehicle-internal clock as a basis for prompting deactivation of the vehicle function when the deactivation instant has been reached. Selection of a deactivation instant, which occurs only after an automatic changeover of the vehicle-internal clock from standard time to daylight saving time or from daylight saving time to standard time is to be expected, prompts output of an indicator.

The invention is based on the insight that the user of an apparatus for time-controlled activation or deactivation of a vehicle function may sometimes be totally unaware that the vehicle is equipped with a system for automatically adjusting the time of the vehicle-internal clock, whose time is evaluated for activating or deactivating the time-controlled function. This may be the case, for example, when taking delivery of a new vehicle or in the event of merely temporary use of the vehicle (e.g. rental vehicle).

If the driver is aware of the general time changeover from standard time to daylight saving time or vice versa, but he does not know that the vehicle-internal clock already takes account of this automatically, the case may arise that he selects an activation or deactivation instant that would be correct for nonautomatic adjustment of the time, but is incorrect after automatic changeover of the time.

To rectify this problem, the inventive apparatus for time-controlled activation of a vehicle function in a vehicle with automatic adjustment of the time of a vehicle-internal clock from standard time to daylight saving time and/or from daylight saving time to standard time has provision for selection of an activation instant that first arises after an automatic changeover of the vehicle-internal clock from standard time to daylight saving time or from daylight saving time to standard time can be expected to prompt output of an indicator.

Similarly, the inventive apparatus for time-controlled deactivation of a vehicle function in a vehicle with automatic adjustment of the time of a vehicle-internal clock from standard time to daylight saving time and/or from daylight saving time to standard time has provision for selection of a deactivation instant that first arises after an automatic changeover of the vehicle-internal clock from standard time to daylight saving time or from daylight saving time to standard time can be expected to prompt output of an indicator.

Advantageously, the advice is output at, or in proximity to, the operator control element, so that the indicator is perceivable to the person who has selected the activation or deactivation instant at the instant of selection of the activation or deactivation instant. The activation or deactivation instant selected can either be a particular instant or a particular period after the expiration of which the vehicle function is intended to be activated or deactivated.

The operator control element that can be used to select the activation or deactivation instant may be part of a vehicle-internal operator control apparatus, e.g. a display operator control unit that is in place in the vehicle anyway, or part of a vehicle-external operator control unit, where the data interchange between the vehicle-external operator control element and the vehicle is effected via a wireless communication interface. Telephone connections and/or radio links and/or Internet connections can be used for this purpose. The selection of the activation or deactivation instant can therefore be made using a mobile phone, a computer and/or an appropriately configured vehicle remote control unit, for example, the operator control apparatus then needing to be equipped with an appropriate piece of software for selecting an activation or deactivation instant for at least one particular vehicle function, such as a preliminary air-conditioning function.

The indicator or the type of output of the indicator can be provided visually, audibly and/or haptically, i.e. the indicator is output as a visually, audibly and/or haptically perceivable indicator. For a visually perceivable indicator, a corresponding report can be provided in a display unit, for example. For an audibly perceivable indicator, a corresponding audible report can be output, for example, which informs the user that an automatic time changeover will take place before the activation or deactivation instant occurs, and this is automatically taken into account. The indicator can be output once or repeatedly. If a visually perceivable indicator is output, this indicator can be automatically deactivated either after expiration of a prescribed timer, e.g. of 5 seconds max., or only when the setting person confirms the indicator by acknowledgement.

So that the setting person can also perceive the indicator, not only must the indicator be output at the—or in proximity to the—operator control element, it must also, in terms of timing, be directly related to the selection of the activation or deactivation instant. "Directly related" can be understood to mean, first, the immediate output of the indicator after selection of the activation or deactivation instant or to mean prompt output of the indicator after selection of the activation or deactivation instant. In this case, prompt means that the indicator needs to be provided within a defined time window, e.g. of 5 seconds max., since otherwise there is the risk of the user already having turned to other activities and no longer perceiving the indicator.

Other objects, advantages and novel features of the present invention will become apparent from the following detailed description of one or more preferred embodiments when considered in conjunction with the accompanying drawing.

BRIEF DESCRIPTION OF THE DRAWING

The single FIG. 1 shows an exemplary design for an apparatus for time-controlled activation of a preliminary air-conditioning function (e.g. stationary heater) in a vehicle in accordance with the invention.

DETAILED DESCRIPTION OF THE DRAWING

In detail, FIG. 1 shows, as a central element of the apparatus, an electronic control unit SE that receives input signals T and t from an (vehicle-external) input operator control unit BE and a vehicle-internal clock U, respectively. These signals can be used by the control unit to produce output signals H and a to the input operator control unit BE and a heating air-conditioning system HKA in the vehicle.

The input operator control unit BE may be part of a radio remote control for the vehicle and includes an operator control element B for selecting an activation instant T for activating the preliminary air-conditioning function and a display A for visually presenting relevant information for the driver. As soon as the driver has selected an activation instant T, the activation instant is sent wirelessly to the control unit SE integrated in the vehicle. The control unit SE then checks whether the activation instant T first arises after an automatic changeover of the relevant vehicle-internal clock U will presumably take place. The instants of future, relevant time changeover can be obtained by the control unit SE from a stored time table, for example, that indicates when changeover from standard time to daylight saving time or from daylight saving time to standard time can be expected.

If the control unit SE establishes that the activation instant T will, under normal circumstances, arise only after automatic time changeover, the control unit SE sends an indication signal H for producing an indicator that is visually presented in the display of the input operator control unit BE. As a result, the driver is advised that time changeover will take place before the activation instant is reached or after expiration of the set timer and this is taken into account automatically.

Regardless of whether indicator H is output on the display A, the control unit monitors the time t of the relevant vehicle-internal clock U for when the activation instant T is reached. As soon as the activation instant T has been reached, the control unit SE sends an activation signal a to the heating air-conditioning system HKA in order to activate the preliminary air-conditioning function.

It is self-evident that an apparatus for time-controlled deactivation of a vehicle function can be of similar design to the apparatus shown here, with, instead of the activation instant, a deactivation instant being selected and said deactivation instant being monitored and evaluated for the triggering of an indicator or the deactivation of the corresponding vehicle function.

If the inventive apparatus is used for automatically activating stationary heaters or stationary air conditioners, for which the driver sets a regular activation time at a particular instant each day, the indicator can be output either when the activation or deactivation instant is (first) set or (additionally) also at a defined instant before the automatic time changeover. By way of example, it is thus possible for the indicator to be output in a display unit in the vehicle one day before the automatic time changeover, as soon as the vehicle is identified as having been started up, that is to say when the driver is in the vehicle.

The automatic indicator function therefore affords the advantage that the driver does not need to remember whether his vehicle has an automatic time changeover function or whether this function is active, since when setting the activation or deactivation instant he is advised thereof if this appears necessary on the basis of the selected activation or deactivation instant.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for time-controlled activation of a vehicle function in a vehicle, comprising:

a vehicle-internal clock configured for automatic adjustment due to a time standard change;

an operator control element configured to enable manual user selection of an activation instant;

an electronic control unit configured to:

receive the selected activation instant and a time of the vehicle-internal clock, activate the vehicle function when the time of the vehicle-internal clock corresponds to the activation instant, determine that the received activation instant will first occur after an expected automatic adjustment of the vehicle-internal clock due to the time standard change, and output a user perceptible indicator based on the determination.

2. The apparatus according to claim 1, wherein the operator control element that is used to manually select the activation instant is a part of a vehicle-internal or vehicle-external operator control apparatus.

3. The apparatus according to claim 1, wherein the indicator output is a visual, audible and/or haptic indicator.

4. The apparatus according to claim 1, wherein the indicator is output immediately after the activation instant has been selected.

5. The apparatus according to claim 1, wherein the indicator is output at, or in proximity to, the operator control element so as to be perceivable immediately after the activation instant is selected.

6. An apparatus for time-controlled deactivation of a vehicle function in a vehicle, comprising:

a vehicle-internal clock configured for automatic adjustment of time due to a time standard change;

an operator control element configured to enable manual user selection of an deactivation instant;

an electronic control unit configured to:

receive the selected deactivation instant and a time of the vehicle-internal clock, deactivate the vehicle function when the time of the vehicle-internal clock corresponds to the deactivation instant, determine that the received deactivation instant will first occur after an expected automatic adjustment of the vehicle-internal clock due to the time standard change, and output a user perceptible indicator based on the determination.

7. The apparatus according to claim 6, wherein the operator control element that is used to manually select the deactivation instant is a part of a vehicle-internal or vehicle-external operator control apparatus.

8. The apparatus according to claim 6, wherein the indicator output is a visual, audible and/or haptic indicator.

9. The apparatus according to claim 6, wherein the indicator output is output immediately after the deactivation instant has been selected.

10. The apparatus according to claim 6, wherein the indicator is output at, or in proximity to, the operator control element so as to be perceivable immediately after the deactivation instant is selected.

11. A method of operating a vehicle equipped with a vehicle-internal clock whose time is automatically adjusted due to a time standard change, and with an operator control element configured to enable manual user selection of an activation instant for a vehicle function, the method comprising the acts of:

receiving, via an electronic control unit in the vehicle, the selected activation instant for a vehicle function;

receiving, via the electronic control unit in the vehicle, a time signal from the vehicle-internal clock, wherein the electronic control unit is configured to utilize the manually selected activation instant and the time signal to activate the vehicle function when the activation instant occurs; and outputting, via the electronic control unit in the vehicle, a user perceptible indicator upon a determination by the control unit that the activation instant first occurs after an expected automatic adjustment of the vehicle-internal clock due to the time standard change.

12. The method according to claim 11, further comprising the acts of:

receiving, via the electronic control unit in the vehicle, a manually selected deactivation instant; and outputting a user perceptible indicator, via the electronic control unit of the vehicle, upon a determination by the control unit that the deactivation instant first occurs after the expected automatic adjustment of the vehicle-internal clock due to the time standard change.

13. The method according to claim 12, wherein the outputting of the indicator occurs immediately after the manually selected activation or deactivation instant has been received by the electronic control unit in the vehicle.

14. The method according to claim 13, wherein the outputting of the indicator is carried out by providing the indicator at, or in proximity to, an operator control element perceptible at the instant the manually selected activation or deactivation instant is received.

* * * * *